US005438733A

United States Patent [19]

Melcher et al.

[11] Patent Number: 5,438,733

[45] Date of Patent: Aug. 8, 1995

[54] COTTON DRAFTING FRAME

[75] Inventors: Paul Melcher, Niederfischbach; Jörg Hummel, Ebersbach/Fils, both of Germany

[73] Assignee: Trützschler GmbH & Co. KG, Mönchengladbach, Germany

[21] Appl. No.: 987,148

[22] Filed: Dec. 8, 1992

[30] Foreign Application Priority Data

Dec. 12, 1991 [DE] Germany ..... 41 40 984.1
Sep. 26, 1992 [DE] Germany ..... 42 32 302.9

[51] Int. Cl.[6] ..... D01H 5/18

[52] U.S. Cl. ..... 19/293; 19/258; 19/260

[58] Field of Search ..... 19/293, 236, 239, 258, 19/260, 237, 240, 294, 288; 192/41 R, 45, 45.1, 46, 45.2

[56] References Cited

U.S. PATENT DOCUMENTS

| | | | |
|---|---|---|---|
| 2,812,553 | 11/1957 | Coulliette | 19/293 |
| 2,895,178 | 7/1959 | Sauvage | 19/293 |
| 4,195,389 | 4/1980 | Schulz et al. | 19/293 |
| 4,266,324 | 5/1981 | Hasegawa et al. | 19/239 |
| 4,332,059 | 6/1982 | Bischofberger et al. | 19/293 |
| 4,480,355 | 11/1984 | Vignon et al. | 19/293 |
| 4,561,152 | 12/1985 | Niimi et al. | 19/293 |
| 4,987,734 | 1/1991 | Meyer | 19/236 |
| 5,161,284 | 11/1992 | Leifeld | 19/260 |

FOREIGN PATENT DOCUMENTS

| | | | |
|---|---|---|---|
| 141505 | 5/1985 | European Pat. Off. . | |
| 0327921 | 8/1989 | European Pat. Off. . | |
| 2704733 | 8/1977 | Germany . | |
| 3801880 | 8/1989 | Germany . | |
| 3805662 | 9/1989 | Germany . | |
| 3920682 | 1/1991 | Germany . | |
| 3008820 | 1/1991 | Japan | 19/293 |
| 778831 | 7/1957 | United Kingdom . | |
| 822355 | 10/1959 | United Kingdom . | |
| 1149627 | 4/1969 | United Kingdom . | |
| 1471414 | 4/1977 | United Kingdom . | |
| 80/00717 | 4/1980 | WIPO . | |

OTHER PUBLICATIONS

Wegener, "Die Streckwerke der Spinnereimaschinen", Springer-Verlag, 1965, pp. 423, 424.

Beitz et al, Dubbel, Taschenbuch für den Maschinenbau, 14th Ed., Springer-Verlag, 1981, p. 414.

Homburg, "Sinus-Former", Industrie Elektrik+Elektronik 33, 1988, No. 4, pp. 103, 104.

Achenbach, "Hat sich gemausert", Elektrotechnik 73, vol. 1/2, Feb. 1991, pp. 28-30, 33.

*Primary Examiner*—Peter Nerbun
*Assistant Examiner*—Michael A. Neas
*Attorney, Agent, or Firm*—Spencer, Frank & Schneider

[57] ABSTRACT

A drafting frame includes first and second drafting roll pairs being spaced from one another consecutively in the direction of sliver advance and each being formed of two cooperating drafting rolls; first and second drive motors; a first torque transmitting arrangement connected to the first drive motor and to one of the drafting rolls of the first drafting roll pair for driving the first drafting roll pair in a forward sense for feeding the sliver in the direction of advance; a second torque transmitting arrangement connected to the second drive motor and to one of the drafting rolls of the second drafting roll pair for driving the second drafting roll pair in a forward sense for feeding the sliver in the direction of advance; an electronic regulating arrangement for regulating an rpm of at least one of the two drive motors for equalizing irregularities of the sliver; a first freewheel backstop for preventing a rotation of the first drafting roll pair in a reverse sense; and a second freewheel backstop for preventing a rotation of the second drafting roll pair in a reverse sense.

21 Claims, 5 Drawing Sheets

COTTON DRAFTING FRAME

CROSS REFERENCE TO RELATED APPLICATION

This application claims the priority of German Application Nos. P 41 40 984.1 filed Dec. 12, 1991 and P 42 32 302.9 filed Sep. 26, 1992.

BACKGROUND OF THE INVENTION

This invention relates to a drafting frame for a spinning machine, particularly a regulated cotton drafting frame which has at least two consecutive roll pairs, each having a roll driven by its own electric motor as well as an electronic regulating device which regulates the rpm of at least one of the electric motors for equalizing irregularities in the sliver.

A drafting frame of the above-outlined type is described, for example, in German Offenlegungsschrift (application published without examination) No. 38 01 880. The driven rolls are associated with arresting means whose function is to prevent, during standstill, an undesired rotation of the rolls which may occur as a result of the tension of the sliver or electronic drifting or other causes.

In a drafting frame for wool in which between two roll pairs needle bars or needle rows are arranged, it is known to associate the rolls with brakes which during the startup and the stoppage are controlled by braking signals in such a manner that they disengage and, respectively, engage upon predetermined braking signals. Such an arrangement is disclosed in European Patent No. 141,505.

In drafting frames for ring spinning machines which have long lower rolls extending in the longitudinal direction of the machine, it is known—as disclosed in Published European Application No. 327 921—to provide, between the drive motors, a reverse rotation preventing pawl-and-ratchet assembly for a driven lower middle roll and for a driven lower delivery roll. Such a construction is to prevent, during standstill, the decay of the torsion effect which has been built up during operation to thus avoid drafting errors. In the freewheeling run the pawl slides over the tips of the ratchet teeth which results in wear. The ratchet is capable of moving in the reverse direction through the maximum tooth division so that a reverse turning of the roll during standstill cannot be entirely prevented.

SUMMARY OF THE INVENTION

It is an object of the invention to provide an improved drafting frame of the above-outlined type in which a reverse rotation of the rolls during standstill is prevented by simple means.

This object and others to become apparent as the specification progresses, are accomplished by the invention, according to which, briefly stated, the drafting frame includes first and second drafting roll pairs being spaced from one another consecutively in the direction of sliver advance and each being formed of two cooperating drafting rolls; first and second drive motors; a first torque transmitting arrangement connected to the first drive motor and to one of the drafting rolls of the first drafting roll pair for driving the first drafting roll pair in a forward sense for feeding the sliver in the direction of advance; a second torque transmitting arrangement connected to the second drive motor and to one of the drafting rolls of the second drafting roll pair for driving the second drafting roll pair in a forward sense for feeding the sliver in the direction of advance; an electronic regulating arrangement for regulating an rpm of at least one of the two drive motors for equalizing irregularities of the sliver; a first freewheel backstop for preventing a rotation of the first drafting roll pair in a reverse sense; and a second freewheel backstop for preventing a rotation of the second drafting roll pair in a reverse sense.

Expediently, between one electric motor and at least two driven rolls a common transmission shaft is arranged which has a freewheel backstop. In this manner only a single freewheel backstop is provided for the main power train for two driven rolls which simplifies construction. The freewheel backstop also blocks all rotary motions upstream thereof. The arrangement has the further advantage that at that location there is sufficient space available for providing the freewheel backstop which replaces a ball bearing.

It is a further advantage of the invention that the freewheel backstop is arranged locally between the two driven rolls so that a certain distance compensation is provided.

The invention has further additional advantageous features as follows:

- With each driven roll there is associated a freewheel backstop.
- The freewheel backstop is arranged coaxially with the roll. In this manner, a play caused by additional gear stages, gear wheels, toothed belts or the like is reduced or eliminated.
- The freewheel backstop is arranged axially parallel to the roll. In this manner, more than one driven roll may be served by a single freewheel backstop.
- With each electric motor there is associated an electronic motor regulator which is connected to the electronic machine control device.
- Each electric motor has a tachogenerator connected with the associated electronic motor regulator.
- The electronic motor regulators are coordinated with one another in such a manner that the desired values which are transmitted by the electronic machine control device to the motor regulators at standstill have a counter torque value for the electric motors, directed opposite to the direction of rotation during normal operation.
- The signals which determine the rotation of the electric motors are applied by the electronic machine control device to the motor regulators.
- The electric motors are a.c. servomotors.
- The electronic control device is, to compensate for irregularities, connected with a measuring member, for example, a groove-and-rib roll pair.
- A common electronic control and regulating device, for example, a microcomputer is used.
- The freewheel backstop is of the sprag type which forms an integral part with a ball bearing. The sprag-type freewheel backstop automatically and immediately locks upon appearance of the smallest reverse torque.
- The drafting frame includes a device which, upon standstill, applies to the electric motors a voltage whose direction of rotation is opposite to the voltage applied during the normal operation and wherein the magnitude of the control voltage applied upon standstill is selected such that an electronic drifting in the operational direction of the electric motors cannot take place. A rotation of the rolls is thus securely prevented, because, on the one hand, the above-noted control voltage acts against the normal direction of rotation and, on the other hand, the freewheel backstop is effective in an opposite direction. The control voltage applied upon standstill is preferably −1 mv.

The freewheel backstop is arranged in a gear stage.

The freewheel backstop is associated with a lower input roll.

The freewheel backstop is integrated in one of the electric motors.

DESCRIPTION OF THE PREFERRED EMBODIMENTS

Figure 1A:
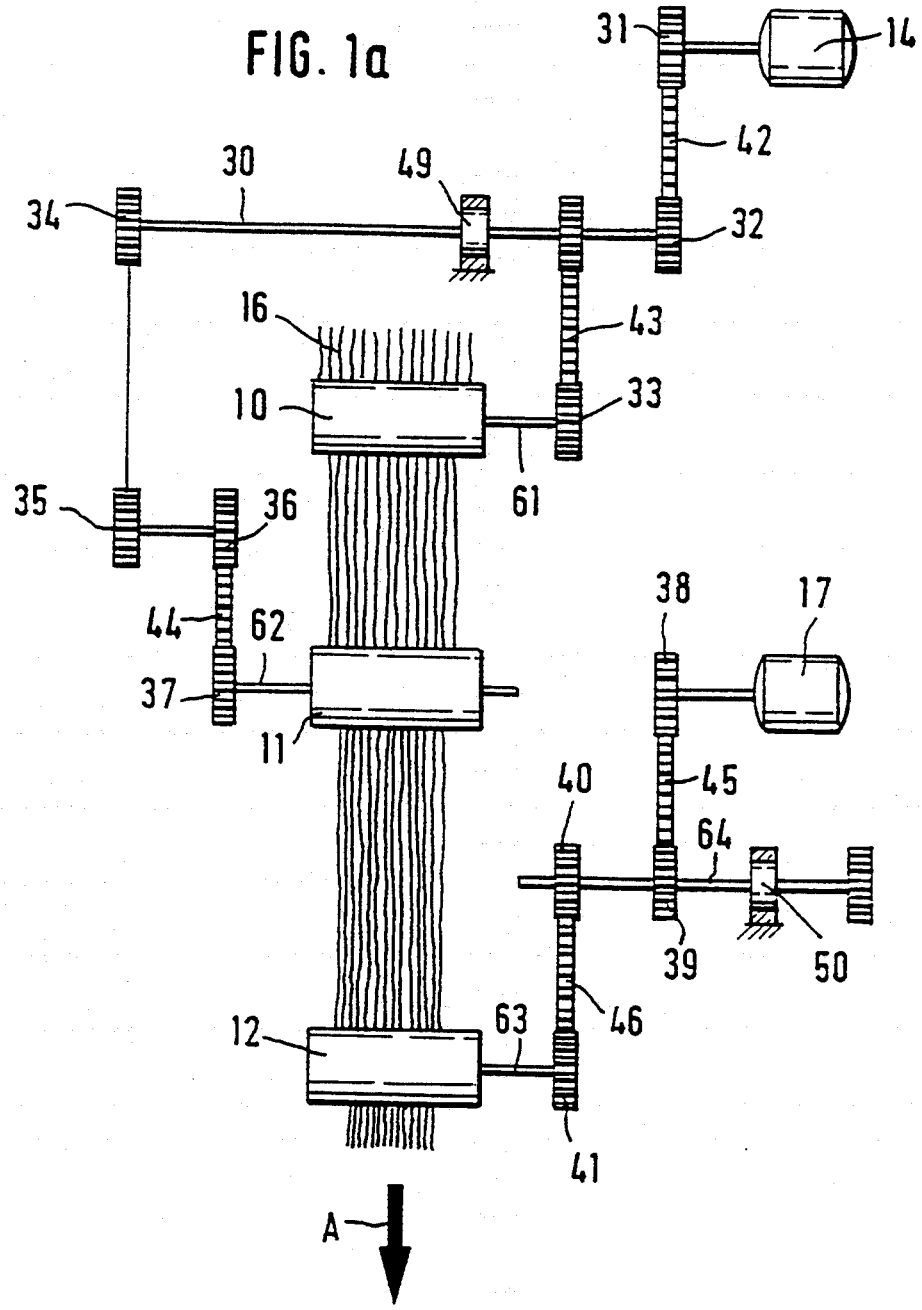
FIG. 1*a* is a schematic plan view of a drafting frame according to a preferred embodiment of the invention, including a freewheel backstop associated with a common transmission shaft.
Figure 1B:
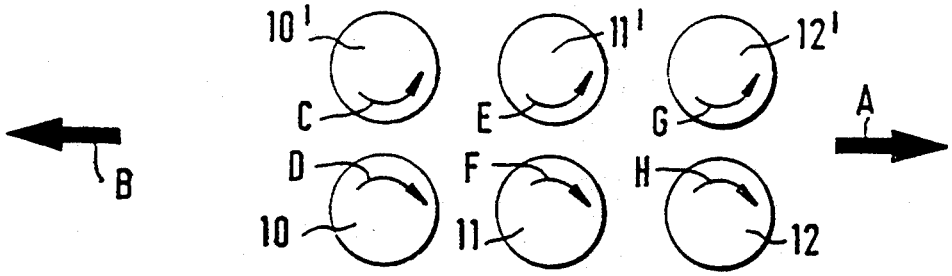
FIG. 1*b* is a schematic side elevational view of some of the components of the construction of FIG. 1*a*.

Turning to FIGS. 1*a* and 1*b*, the regulated drafting frame shown therein has an input roll pair 10, 10' a middle roll pair 11, 11' and an output roll pair 12, 12'. In each roll pair the respective lower rolls 10, 11 and 12 are motor-driven. The lower rolls 10, 11 and 12, as shown in FIG. 1*b*, cooperate with respective, freely rotatable upper rolls 10', 11' and 12', each pressed downwardly by non-illustrated, adjustable force-exerting means. The lower input roll 10 and the lower middle roll 11 are connected to one another by a stepping gear whose transmission ratio corresponds to a predetermined pre-drafting. The lower input roll 10 and thus the lower middle roll 11 are driven by an electric motor 14. The transmission shaft 30 driven by the motor 14 through gear 31, toothed belt 42 and gear 32, includes a freewheel backstop 49 which prevents a rotation of the lower input roll 10 and the lower middle roll 11 against the normal direction of run A of a sliver 16. The transmission shaft 30 drives the lower input roll 10 by gears 32*a*, 33 and drive belt 43, as well as shaft 61. The transmission shaft 30 also drives the lower middle roll 11 by gears 34, 35, 36 and 37, as well as toothed belt 44 and shaft 62.

The lower output roll 12 is driven by an electric motor 17 via gears 38, 39, 40 and 41, as well as toothed belt 45, 46 and shafts 63 and 64. The shaft 64 contains a freewheel backstop 50 which prevents rotation of the lower output roll 12 against the running direction A of the sliver 16. The rpm's of the electric motors 14 and 17 are regulated in such a manner by an electronic control device that in the principal drafting zone between the middle roll pair 11, 11' and the output roll pair 12, 12' a draft up to the desired fineness is achieved, while simultaneously mass fluctuations of the incoming sliver 16 are compensated for as much as possible.

By means of the above-described transmission elements connected to the rolls 10 and 11 are adjustable. The freewheel backstops 49 and 50 are arranged axially parallel to the rolls 10, 11 and 12, respectively.

Figure 2A:
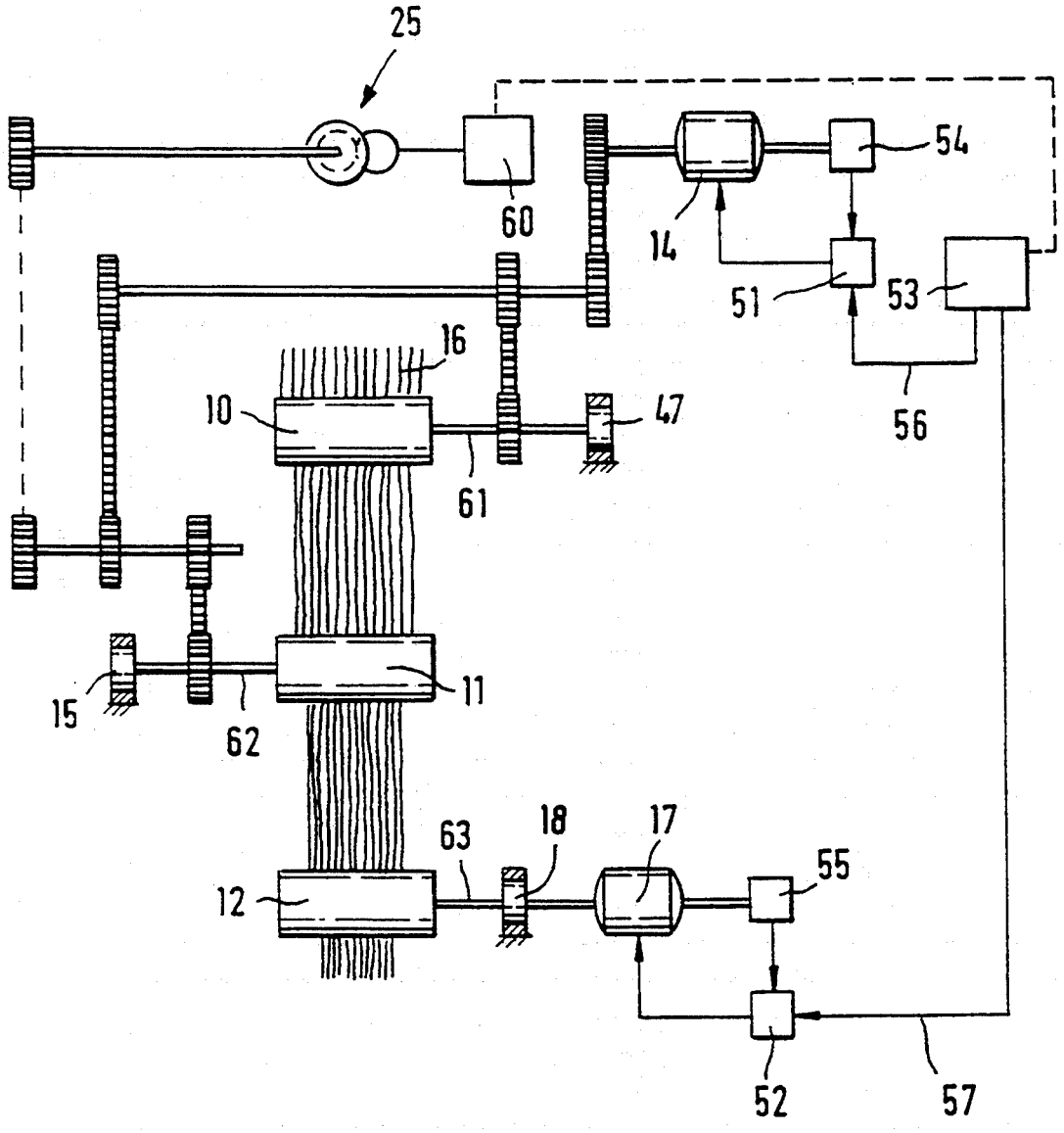
FIGS. 2*a* and 2*b* are block diagrams of devices for preventing, during standstill, a motor drifting in the operational direction.
Figure 2B:
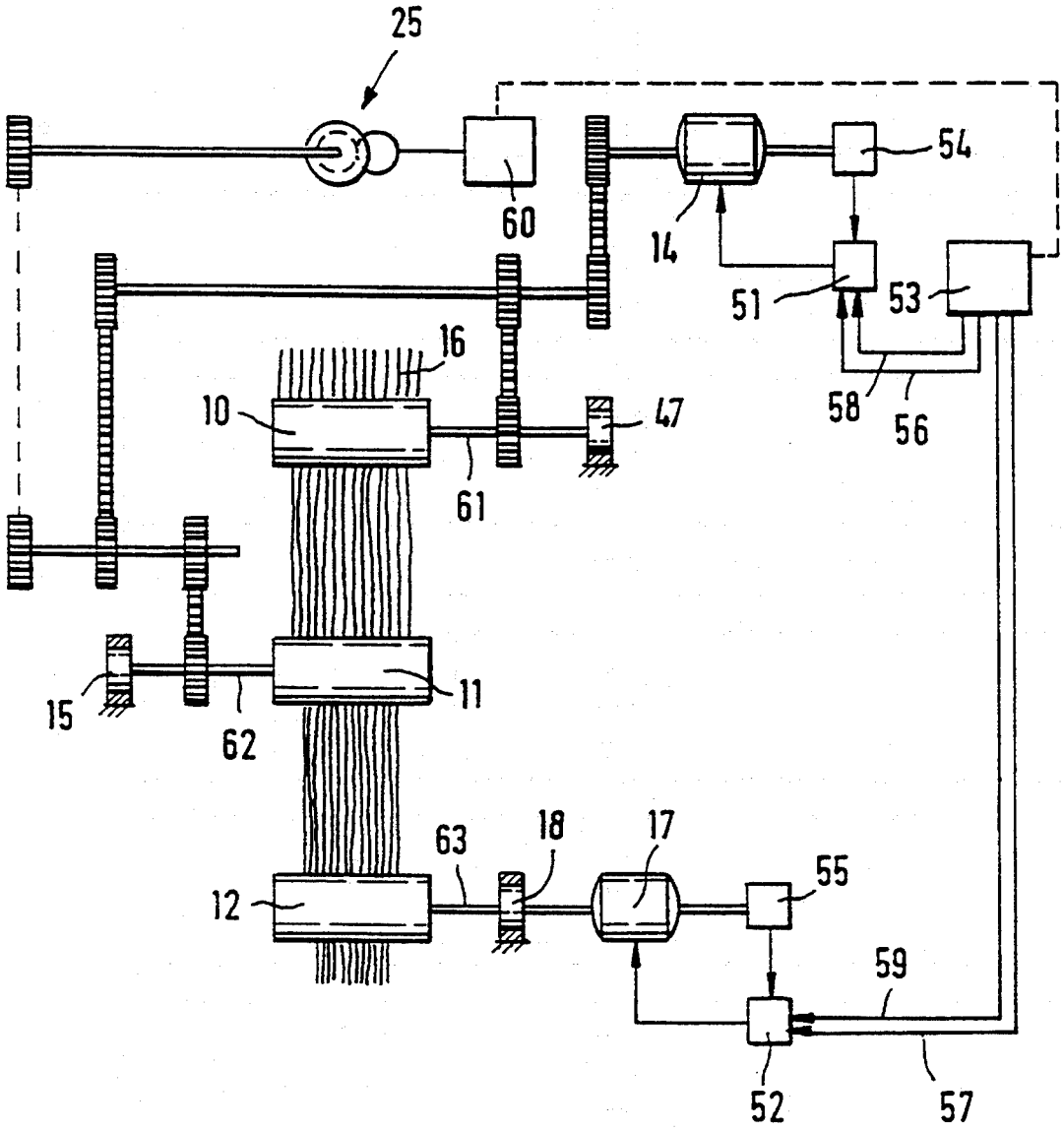

Turning to FIG. 2*a*, with electric motors 14 and 17 there are associated separate respective electronic rpm regulators 51 and 52 which are connected to a common electronic machine control device 53. With the electric motors 14 and 15 there are connected separate respective tachogenerators 54 and 55 which are connected with the associated electronic motor (rpm) regulators 51 and 52. The electronic motor regulators 51 and 52 are coordinated electrically with one another in such a manner that upon standstill the desired values 56 and 57 for the rpm and the direction of rotation transmitted by the electronic machine control device 53 to the motor regulators 51, 52 generate a torque in the electric motors 14 and 17 which is opposite to the normal driving torque. The normal driving direction is designated by arrows C through H in FIG. 1*b*. As shown in FIG. 2*b*, the signals 58 and 59 transmitted by the electronic machine control device 53 which additionally define the direction of rotation of the electric motors 14 and 17 are applied to the motor regulators 51 and 52. The desired values determine here solely the rpm. The electronic machine control device 53 may be a common electronic control and regulating apparatus and may include a microcomputer and a non-illustrated electronic regulating device for equalizing irregularities.

A measuring value converter 60 converts the excursions of the rib-and-groove roll pair 25 into electronic signals.

The electronic motor regulators 51 and 52 are compensated in such a manner that the desired values 56 and 57 transmitted during standstill impart to the motors 14 and 17 a slight torque which is opposite to the normal operation; a rotation is, however, prevented by the freewheel backstops 49 and 50 (FIGS. 1*a*, 1*b*) as well as 15, 18 and 47 (FIGS. 2*a*, 2*b*). In this manner, a forward run lock is obtained.

The lower rolls 10, 11 and 12 have an rpm of, for example, 1400, 2000 and 7200 and a diameter of, for example, 35 mm, 35 mm and 40 mm, respectively. At the output of the rolls 12, 12' the sliver speed is approximately 900 m/min at an rpm of 7200 of the lower output roll 12.

The freewheel backstops 15, 18, 47, 49 and 50 provide for a rotary motion of the rolls only in a single direction, that is, in the feed direction C–H (as shown in FIG. 1*b*) during operation. After standstill of the drafting frame the freewheel-backstops prevent a reverse rotary motion of the rolls.

Figure 3A:
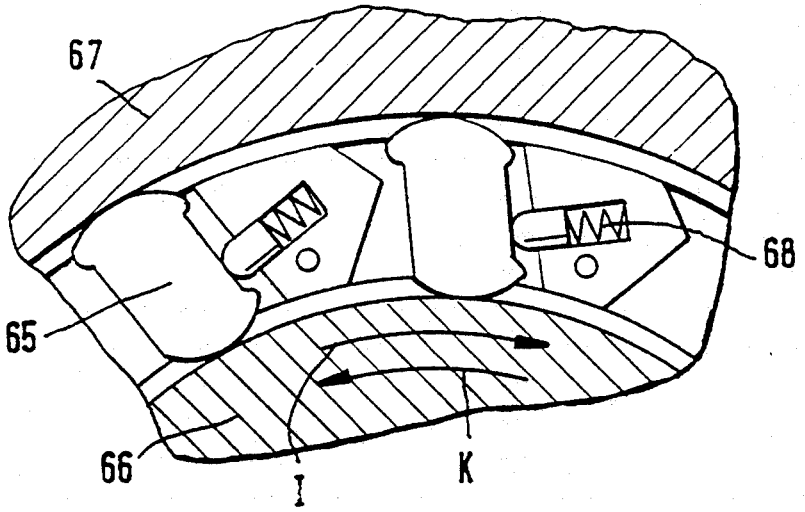
FIG. 3*a* is a fragmentary sectional side elevational view of a sprag-type freewheel backstop for use in the invention.
Figure 3B:
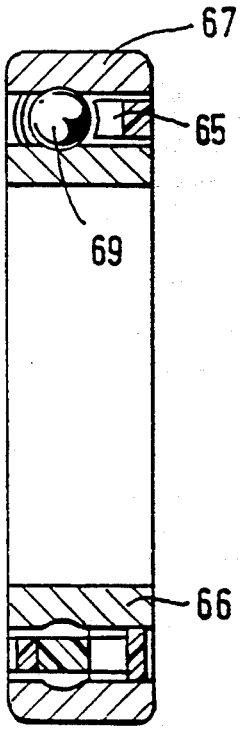
FIG. 3*b* is an axial sectional view of the construction shown in FIG. 3*a*.
Figure 3C:
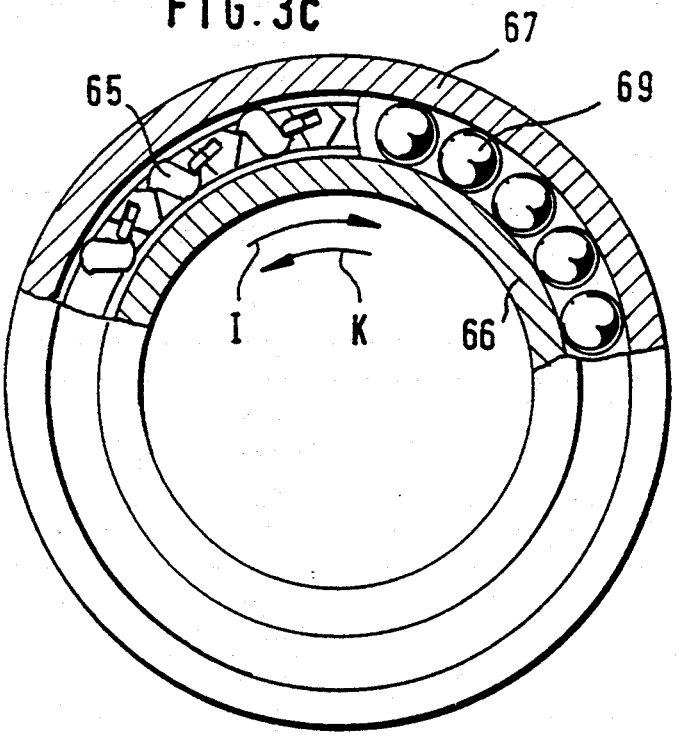
FIG. 3*c* is a side elevational view, partially in section, of an entire freewheel backstop of FIGS. 3*a* and 3*b*.

Turning to FIGS. 3*a*, 3*b* and 3*c*, in the ball bearing/-freewheel backstop assembly the bearing balls 69 are situated in a robust cage which also guides a plurality of individually spring-biased sprags 65 which have, in the freewheeling direction I, based on their geometrical shape, a "lifting tendency" which at high rpm's results in a complete freedom of contact for the inner race 66 and the outer race 67. A sufficient relative cage rpm derived from a sufficient radial load of the bearing is of importance. The freewheel backstops 15, 18, 47, 49 and 50 operate steplessly and in a form-locking manner. The sprags 65 lift off the races 66, 67 in the freewheeling direction I by virtue of centrifugal forces. In the reverse direction K a clamping and thus a locking effect is obtained by virtue of the pressing of the spring 68 against the sprags 65 which engage the races 66, 67. The inner race 66 is press fitted on a shaft passing through the freewheel backstop. The shaft may be, for example, a drive shaft of a driven roll 10, 11 or 12, or a transmission shaft between a drive motor and the associated driven roll. When the drafting frame is at a standstill, the shaft passing through the freewheel backstop is prevented from rotating in the reverse sense (opposite to the normal, forward rotation) due to the fact that the sprags lock the inner race 66 (to which the throughgoing shaft is affixed) to the fixedly held (non-rotatable) outer race 67.

It will be understood that instead of sprag-type freewheel backstops, other types of one-way clutch constructions, for example, clamping roller-type freewheel backstops may be used. Further, the invention also comprises unsupported freewheel backstops in which the shaft is supported by a separate bearing, such as roller bearings and also encompasses supported (combined) freewheel backstops in which the freewheel backstop and, for example, the roller bearing (ball bearing, cylinder roll bearing, needle bearing, barrel bearing, and the like) form an integral assembly as illustrated in FIGS. 3*b* and 3*c*.

The reverse run lock obtained by freewheel backstops 15, 18, 47, 49 and 50 prevents a reverse rotation of the rolls during standstill. The reverse turning motion practically always occurs and is caused particularly by the tension of the sliver and the drive belt.

The forward run lock obtained by the counter torque for the electric motors 14 and 17 has the further advantage that undesired forward rotation of the rolls during standstill cannot take place. A forward rotation occurs only if the motor regulating devices 51, 52 are not equalized exactly to ±0, that is, a forward rotation may occur. The desired equalization is present when in the case of a desired value 56, 57 of zero the electric motors 14 and 17 are stationary. In operation, however, a deviation may occur from the zero equalization and thus an electronic drifting in the forward direction may occur which, however, is prevented by the counter torque.

Figure 4:
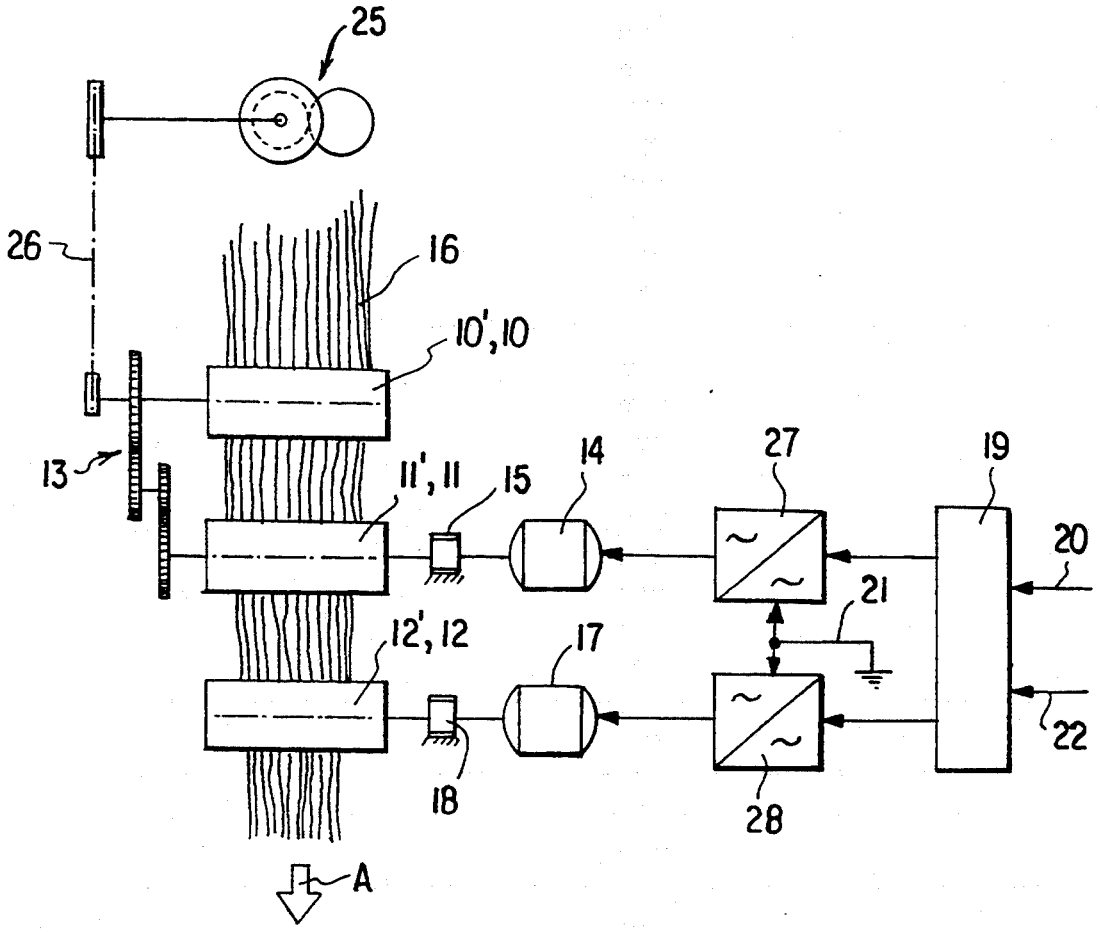
FIG. 4 is a schematic plan view of another preferred embodiment of the invention.

The regulated drafting frame illustrated in FIG. 4 has an input roll pair 10, 10', a middle roll pair 11, 11' and an output roll pair 12, 12' of which the lower rolls 10, 11 and 12, respectively, are driven. With each lower roll there is associated a freely rotatable respective upper roll 10', 11' and 12' provided with a mechanism for exerting an adjustable pressing force. The lower input roll 10 and the lower middle roll 11 are connected with one another by a gear stage 13 whose transmission ratio corresponds to a predetermined pre-drafting. The lower middle roll 11 and thus also the lower input roll 10 are driven by an electric motor 14. Between the electric motor 14 and the lower middle roll 11 a freewheel backstop 15 is arranged which prevents rotation of the lower middle roll 11 and the lower input roll 10 in a direction against the running direction A of a sliver 16.

The lower output roll 12 is driven by an electric motor 17. Between the electric motor 17 and the lower output roll 12 a freewheel backstop 18 is disposed which prevents the lower output roll 12 from rotating in a direction opposite to the direction of advance A of the sliver 16.

The rpm's of the electric motors 14 and 17 are regulated by an electronic regulating device 19 such that, on the one hand, in the principal drafting zone between the middle roll pair 11, 11' and the output roll pair 12, 12' a draft up to the desired fineness is achieved while, on the other hand, mass fluctuations of the running sliver 16 are equalized as much as possible. The mass fluctuations of the sliver 16 are detected by means of a sensor device situated upstream of the input roll pair 10, 10' and are, as a regulating signal 20, applied to the electronic regulating device 19. The sensor device is constituted by a known rib-and-groove roll pair 25 through which the sliver 16 runs to cause radial deflections (excursions) of one of the rolls of the detector roll pair 25. The latter is driven by a belt drive 26 from the lower input roll 10 and thus from the electric motor 14. The electronic regulating device 19 applies a control voltage of between 0 to approximately 10 V to the frequency converter 27, 28 connected to the input of the electric motors 14 and 17 so that even in the low rpm range a precise regulation is feasible. The frequency converters 27, 28 which are connected to an a.c. supply 21 of 380 V and are coupled to the net frequency, supply the electric motors 14 and 17 with a frequency and torque voltage which is dependent from the applied control voltages.

The electronic regulating device 19 is, in a manner not shown in more detail, provided with a starting and stopping device whose signal, designated with an arrow 22, is applied to the electronic control device 19. Upon receiving a stopping signal, the electronic regulating device 19 changes the control frequency of the synchronous electric motors 14 and 17 to zero. The freewheel backstops 15 and 18 which may be commercially available roller bearing freewheel backstops block a reverse rotation of the lower rolls 10, 11 and 12, that is, they prevent a rotation thereof against the normal running direction A of the sliver 16.

Since the electronic components of the electronic regulating device 19 do not cause—unlike mechanical switches—a total interruption of voltages and currents, there are risks that an electronic drifting will be present, that is, a slight torque will seek to rotate one or both electric motors 14, 17. As a rule, it is permissible that in case of a voltage interruption, residual voltages in the order of magnitude of +1 mV may appear which then may be the cause for a drifting of the electric motors 14 and 17. In order to exclude the possibility of such an electronic drifting, it is further provided that the electronic regulating device 19, after the frequency-controlled stoppage, substitutes a slight control voltage at the frequency converter of the electric motors 14 and 17 for the then-supplied slight voltage and thus reverses the direction of rotation as compared to the rotary direction during normal operation. In this manner, the electric motors 14 and 17 are exposed to a relatively slight torque against their normal operational torque so that the freewheel backstops 15 and 18 are "activated", and thus an incidental rotation of the lower rolls 10, 11 and 12 in the normal running direction A of the sliver 16 is also prevented.

As already noted earlier, upon shutting off the control voltage a residual voltage of +1 mV is permissible in practice. In such a case, it is sufficient if upon stoppage a control voltage in the order of magnitude of −1 mV is applied so that then a control voltage between 0 and −2 mV is present. In this manner, an electronic drifting is prevented with sufficient certainty. It is noted that the plus sign stands for a control voltage generating a torque in the normal operational direction (forward sense) whereas a minus sign stands for a control voltage generating a torque opposite the normal operational direction (reverse sense).

Departing from the embodiment illustrated in FIG. 4, the freewheel backstop 15 may also be installed at a location other than between the electric motor 14 and the lower mid roll 11. For example, the freewheel backstop 15 may be located in the gear stage 13 or may be associated with the lower input roll 10. Similarly, the freewheel backstop 15 may be integrated into the electric motor 14. Also, it is not necessary to provide the freewheel backstop between the lower output roll 12 and the electric motor 17; it may be, for example, integrated in the electric motor 17.

While in the embodiments described in connection with FIGS. 1*a*, 2*a* and 4, the drive motor 14 rotates two drafting roll pairs (10, 10' and 11, 11'), it is feasible within the scope of the invention to omit one of the roll pairs and thus associate the drive motor 14 with but a single drafting roll pair. Similarly, while in the described embodiments the drive motor 17 rotates a single drafting roll pair 12, 12', it is feasible within the scope of the invention to couple to the drive motor 17 a further drafting roll pair (arranged, for example, downstream of the roll pair 12, 12') in which case then the gearing driven by the drive motor 17 may be similar to the gearing which, in the described embodiments, is driven by the drive motor 14 and is coupled to the drafting roll pairs 10, 10' and 11, 11'.

It will be understood that the above description of the present invention is susceptible to various modifications, changes and adaptations, and the same are intended to be comprehended within the meaning and range of equivalents of the appended claims.

What is claimed is:

1. A drafting frame for drafting sliver passing through the drafting frame in a direction of advance, comprising (a) first and second drafting roll pairs being spaced from one another consecutively in said direction of advance and each being formed of two cooperating drafting rolls; one drafting roll in each said drafting roll pair being a driven roll;

(b) first and second drive motors;

(c) first torque transmitting means connected to said first drive motor and to the driven roll of said first drafting roll pair for driving said first drafting roll pair in a forward sense for feeding said sliver in said direction of advance;

(d) second torque transmitting means connected to said second drive motor and to the driven roll of said second drafting roll pair for driving said second drafting roll pair in a forward sense for feeding said sliver in said direction of advance;

(e) electronic regulating means for regulating an rpm of at least one of said first and second drive motors for equalizing irregularities of the sliver;

(f) first freewheel means for preventing a rotation of said first drafting roll pair in a reverse sense; said reverse sense being opposite to said forward sense; and (g) second freewheel means for preventing a rotation of said second drafting roll pair in a reverse sense; said reverse sense being opposite to said forward sense.

2. The drafting frame as defined in claim 1, wherein said first torque transmitting means includes a transmission shaft containing said first freewheel means.

3. The drafting frame as defined in claim 1, wherein said first and second freewheel means are arranged coaxially with each respective driven roll.

4. The drafting frame as defined in claim 1, wherein said freewheel means are arranged axially parallel to each respective driven roll.

5. The drafting frame as defined in claim 1, wherein said electronic regulating means comprises an electronic machine control device and a first and second electronic motor regulator connected to said electronic machine control device; said first and second electronic motor regulators being connected to said first and second drive motors.

6. The drafting frame as defined in claim 5, further comprising a first tachometer connected to said first electronic motor regulator and said first drive motor and a second tachometer connected to said second electronic motor regulator and said second drive motor.

7. The drafting frame as defined in claim 5, wherein said first and second electronic motor regulators are coordinated such that upon standstill of the drafting frame said electronic machine control device applies desired values to said first and second electronic motor regulators for generating in said first and second drive motors a torque urging said driven rolls in said reverse sense.

8. The drafting frame as defined in claim 1, wherein said first and second drive motors are a.c. servomotors.

9. The drafting frame as defined in claim 5, further comprising a detector means for sensing irregularities in said sliver upstream of said first drafting roll pair as viewed in said direction of advance; said detector means being connected to said electronic machine control device.

10. The drafting frame as defined in claim 1, wherein said electronic regulating means comprises a microcomputer.

11. The drafting frame as defined in claim 1, wherein at least one of said first and second freewheel means comprises a sprag-type freewheel backstop.

12. The drafting frame as defined in claim 1, wherein at least one of said first and second freewheel means comprises a freewheel backstop forming an integral part with a ball bearing.

13. The drafting frame as defined in claim 1, wherein said electronic regulating means includes means for applying, upon standstill of the drafting frame, to said first and second drive motors a first voltage generating a first torque which is opposite to a second torque generated by a second voltage; said second torque rotating said drafting roll pairs in said forward sense.

14. The drafting frame as defined in claim 13, wherein said second voltage has a magnitude preventing an electronic drifting of said first and second drive motors in said forward sense.

15. The drafting frame as defined in claim 14, wherein said first voltage is approximately $-1$ mV.

16. The drafting frame as defined in claim 1, wherein at least one of said first and second freewheel means is arranged in one of said first and second torque transmitting means.

17. The drafting frame as defined in claim 1, wherein said first torque transmitting means comprises a transmission shaft connected to the driven roll of said first drafting roll pair and said first freewheel means is connected to said transmission shaft.

18. The drafting frame as defined in claim 1, wherein said first torque transmitting means is incorporated in said first drive motor.

19. The drafting frame as defined in claim 1, wherein said second torque transmitting means is incorporated in said second drive motor.

20. The drafting frame as defined in claim 1, further comprising a third drafting roll pair situated between said first and second drafting roll pairs and being formed of two cooperating drafting rolls; one drafting roll of the third drafting roll pair being a driven roll; further wherein said first torque transmitting means is connected to said first drive motor and to the driven roll of said third drafting roll pair for driving said third drafting roll pair in the forward sense; said first freewheel means preventing rotation of said third drafting roll pair in the reverse sense.

21. The drafting frame as defined in claim 20, wherein said first freewheel means includes two freewheel backstops connected to the driven roll of the respective said first and third drafting roll pairs and said second freewheel means includes a freewheel backstop connected to the driven roll of said second drafting roll pair.

* * * * *